US005722247A

United States Patent [19]

Albertson et al.

[11] Patent Number: 5,722,247

[45] Date of Patent: Mar. 3, 1998

[54] RECOVERY SYSTEM FOR VERY HIGH-PRESSURE REFRIGERANTS

[75] Inventors: Luther D. Albertson, New Albany; Walter R. Key, Greenwood, both of Ind.

[73] Assignee: Redi-Controls Inc., Greenwood, Ind.

[21] Appl. No.: 728,765

[22] Filed: Oct. 11, 1996

[51] Int. Cl.[6] ..... F25B 45/00

[52] U.S. Cl. ..... 62/149; 62/292

[58] Field of Search ..... 62/77, 85, 292, 62/149, 125, 126

[56] References Cited

U.S. PATENT DOCUMENTS

| | | | |
|---|---|---|---|
| 4,364,236 | 12/1982 | Lower et al. | 62/292 |
| 4,688,388 | 8/1987 | Lower et al. | 62/126 |
| 5,127,239 | 7/1992 | Manz et al. | 62/292 |
| 5,247,802 | 9/1993 | Maniez et al. | 62/77 |
| 5,247,804 | 9/1993 | Paige | 62/149 |
| 5,339,642 | 8/1994 | Laukhuf | 62/77 |
| 5,339,647 | 8/1994 | Albertson et al. | 62/292 |
| 5,501,082 | 3/1996 | Tachibana et al. | 62/149 |
| 5,502,974 | 4/1996 | Zugibe | 62/77 |
| 5,511,387 | 4/1996 | Tinsler | 62/292 |

*Primary Examiner*—John M. Sollecito

*Attorney, Agent, or Firm*—Woodard, Emhardt, Naughton, Moriarty & McNett

[57] ABSTRACT

An improved system for recovering and charging refrigerant of a refrigeration system. The system includes a series arrangement of two gas compressors that boost the pressure of the recovered refrigerant to a high enough level for storage in a DOT-3AA type cylinder. The recovered refrigerant is not condensed to the liquid state during recovery, nor is the cylinder chilled. The second high-pressure compressor includes a free-floating piston within a cylinder. The piston is hydraulically actuated. The system includes microprocessor control. The system is well suited for recovery of refrigerants such as R-13, R-23, R-503, and SUVA-95.

44 Claims, 4 Drawing Sheets

RECOVERY SYSTEM FOR VERY HIGH-PRESSURE REFRIGERANTS

BACKGROUND OF THE INVENTION

1. Field of the Invention

The present invention relates generally to systems for recovering and charging refrigerant, and particularly to those systems utilizing high-pressure refrigerants.

2. Description of the Related Art

Various laboratory, commercial and industrial low temperature refrigeration systems use high-pressure refrigerants such as R-13, R-23, R-503, and SUVA-95. Periodically, these refrigeration systems require maintenance. Since federal laws prohibit intentional venting of these refrigerants to the atmosphere, they must be recovered from the refrigeration system and stored before maintenance can begin.

Storage is typically performed after condensing the recovered refrigerant to the liquid state. Once in the liquid state, the low to moderate outlet pressures of typical compressors are adequate to make efficient use of typical storage containers.

To convert the recovered refrigerant to the liquid state, many recovery systems utilize a separate compressor and condenser. However, if the recovered refrigerant is of the high-pressure type, such as R-503, then it may not be possible to use typically available compressors or condenser cooling mediums such as air and water. This is because refrigerants such as R-503 require a combination of high-pressure and low temperature before entering the liquid state. For example, R-503 at a pressure of approximately 230 psia must be cooled to approximately 0° F. before it will condense.

Compounding this problem is the latent heat within the storage container. Before the storage container will hold a refrigerant such as R-503 in the liquid state, the container must be cooled. At least one design, described in U.S. Pat. No. 5,339,647 to Albertson et al., employs a separate cooling system with a compressor, condenser, and evaporator whose purpose is to cool both the recovered refrigerant and the storage tank.

A need therefore exists for an economical and efficient method of quickly recovering high-pressure refrigerants. Such a system should be able to generate high refrigerant pressure without using expensive or bulky compressors. If refrigeration pressure is sufficiently high, then it could be transferred to a storage container in the gaseous state, eliminating the need to condense the refrigerant or cool the storage tank. These features should be combined in a package that is portable. The present invention addresses these needs.

SUMMARY OF THE INVENTION

Briefly describing the present invention, there is provided a system for recovering and charging refrigerant of a refrigeration system. One embodiment of the invention comprises a compressor for receiving refrigerant and expelling it at a higher pressure, and a cylinder defining an internal chamber with a refrigerant port and a hydraulic port. A first check valve provides fluid communication from the compressor outlet to the refrigerant port, permitting flow of expelled refrigerant to the cylinder but restricting refrigerant flow out of the cylinder. Within the cylinder is a free-floating, slidable piston that divides the internal chamber into a first variable volume in fluid communication with the refrigerant port and a second variable volume in fluid communication with the hydraulic fluid port. The piston is hydraulically actuated from the hydraulic fluid port. When the second variable volume is supplied with low pressure hydraulic fluid, the first variable volume will fill with refrigerant expelled from the compressor. When high-pressure hydraulic fluid is provided to the hydraulic fluid port, refrigerant contained within the first variable volume will be discharged through a second check valve. The second check valve restricts refrigerant from flowing into the refrigerant port. Hydraulic fluid is supplied to the piston by a means for hydraulically actuating the piston, which is controlled by a controller. The controller cycles the piston actuating means between supply of low pressure and high-pressure hydraulic fluid.

One object of the present invention is to provide a recovery system for high-pressure refrigerants that does not need to convert the refrigerant to the liquid phase.

Another object of the present invention is to provide a system for recovery of high-pressure refrigerants that does not require cooling the storage container prior to introducing the recovered refrigerant.

Another object of the present invention is to provide a system for recovery of high-pressure refrigerants that is reliable and economical to build and operate.

These and other objects and advantages of the present invention will be apparent from the following description.

DESCRIPTION OF THE PREFERRED EMBODIMENT

Figure 1:
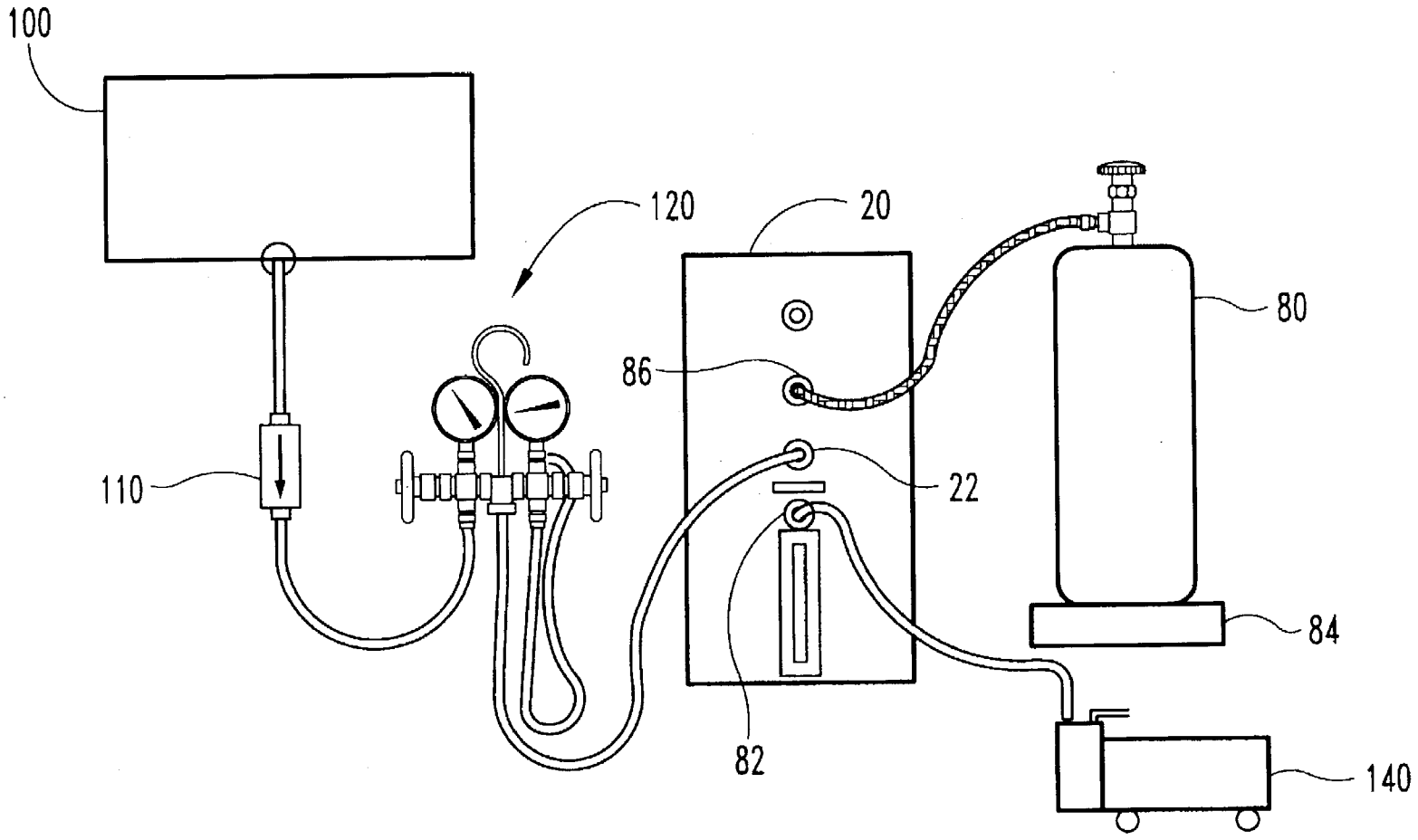
FIG. 1 shows the preferred embodiment of the present invention configured to recover refrigerant from a refrigeration system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to a microprocessor-controlled portable apparatus for recovering high-presssure refrigerant from a refrigeration system and storing it in a storage tank, or alternatively, for transferring refrigerant from a storage tank and charging a refrigeration system. Refrigerant is transferred in the gaseous state. The present invention uses a first compressor to remove refrigerant from the refrigeration system, cools the gas in an air-cooled heat exchanger, and then pumps the refrigerant by a second compressor to a high-pressure for storage in a tank. The present invention is particularly well suited for high-pressure refrigerants such as R-13, R-23, R-503 and SUVA-95. The present invention is known as the Model RS-503/13-H Recovery System and is sold by Redi-Controls, Incorporated, of Greenwood, Ind.

The compressor 30 compresses the refrigerant to approximately 250 psi during typical operation. It is also capable of removing refrigerant from the refrigeration system down to approximately 0 psig. There are two bypass loops around the pump. One incorporates a bypass relief valve that protects the compressor by opening if outlet pressures become too high. The other incorporates a two-position, two-way solenoid valve controlled by the microprocessor. This valve is opened when the compressor is started. It unloads the compressor so that it is easier to start. Operation of the electric motor that powers the compressor is also controlled by the microprocessor. For example, the compressor is turned on to fill the cylinder with refrigerant, but then is turned off when the piston actuating means is causing the cylinder to discharge the refrigerant. In the preferred embodiment, the compressor is of the reciprocating piston type, but any compressor with suitable pressure capability will work.

A heat exchanger 40 cools the recovered refrigerant after it is expelled by the compressor. In the preferred embodiment, the heat exchanger is air-cooled by a fan controlled by the microprocessor, but it is could also be cooled by water or other mediums.

A pair of check valves 44 and 58 are in fluid communication with the refrigeration port of the cylinder. These check valves are oriented to permit flow in a forward direction from the compressor to the cylinder, and from the cylinder to a storage tank. They restrict flow in the reverse direction, permitting only negligible leakage.

The cylinder 50 contains a free-floating piston 52 capable of reversing direction and alternately filling with either recovered refrigerant or hydraulic fluid. One end of the cylinder includes a refrigeration port for receiving recovered refrigerant from the compressor. The other end of the cylinder contains a hydraulic fluid port for receiving hydraulic fluid from the hydraulic pump. The compressor and hydraulic pump operate in an alternating cycle where in one part of the cycle the compressor is on, the hydraulic pump is off, and refrigerant fills the cylinder from the refrigeration port. Once the piston has travelled the length of the cylinder and the cylinder is full of recovered refrigerant, the compressor is turned off and the hydraulic pump is turned on. Hydraulic fluid enters the end of the cylinder with the hydraulic fluid port and the piston reverses direction, forcing recovered refrigerant out through the second check valve and into the storage tank.

In the preferred embodiment, the cylinder has a constant inner diameter throughout the length over which the piston slides. However, it would also be possible to use a dual-diameter piston and a dual inner diameter cylinder, such as a pressure amplifier or pressure intensifier.

The means for hydraulically actuating the piston includes a reservoir of hydraulic fluid, a hydraulic pump 60, a solenoid valve and an oil cooler. The hydraulic pump is driven by an electric motor under the control of the microprocessor, and is capable of approximately 1200 psi outlet pressure. The solenoid valve is a two-position, three-way valve controlled by the microprocessor. After the cylinder is charged with recovered refrigerant, the microprocessor turns off the compressor, turns on the hydraulic pump, and positions the solenoid valve to permit hydraulic fluid into the second variable volume of the cylinder. After the cylinder has discharged all of the recovered refrigerant, the microprocessor will turn off the pump, and position the solenoid valve such that the hydraulic fluid port of the cylinder is in fluid communication with the oil cooler, and through the reservoir. In the preferred embodiment, the oil cooler is air cooled by a fan controlled by the microprocessor, but any readily available cooling medium could be used. The piston actuating means may also include other components and features, for example, a breather and vent port, a sight glass for measurement of oil within the reservoir, a high-pressure relief valve to protect the pump from excessive output pressure, a filter, or other similar components known to those skilled in the art.

The storage tank 80 for the recovered refrigerant should comply with DOT-3AA. The total weight of refrigerant stored in the tank must be known. The tank must not be over-filled.

The controller 70 of the preferred embodiment is mircroprocessor based, although it is also possible for the controller to be analog in nature. The controller controls the operation of the compressor motor, the hydraulic pump motor, the hydraulic solenoid, the compressor bypass solenoid, and the cooling air fans for the refrigerant heat exchanger and the oil cooler. Sensory inputs to the controller include four pressure transducers, one each for measurement of refrigerant inlet pressure, compressor discharge pressure, hydraulic pump output pressure, and refrigerant outlet pressure. Electrical connections to the controller are shown as dotted lines.

These pressure transducers provide data from which the microprocessor operates the basic cycle of the preferred embodiment, and also from which the microprocessor performs diagnostic and safety functions. The basic cycle includes the compressor and hydraulic pump alternating their operational period, and in which the cylinder alternately fills with refrigerant or hydraulic fluid. This controlling algorithm includes measurement of compressor discharge pressure and hydraulic pump output pressure.

When the compressor is on and the first variable volume of the cylinder is filling with recovered refrigerant, compressor discharge pressure will be less than its maximum pressure, dead-headed value. Once the cylinder is full of refrigerant and the piston stops stroking, compressor discharge pressure will rise to its maximum level. The microprocessor will detect this change in pressure and estimate that the cylinder is full. It will then turn off the compressor and turn on the hydraulic pump and cycle the hydraulic pump solenoid valve. High-pressure hydraulic fluid will then be directed to fill the second variable volume of the cylinder, causing the piston to stroke toward the refrigerant port, and discharge the recovered refrigerant through the second check valve and into the storage tank.

As the second variable volume fills with hydraulic fluid, the outlet pressure of the hydraulic pump is less than its maximum or dead-headed value. Once the piston stops stroking and the discharge is complete, hydraulic pressure will rise to the maximum or dead-headed level. This change is detected by the microprocessor and used to estimate that the discharge is complete. The microprocessor will then turn off the pump and cycle the hydraulic pump solenoid valve so that the second variable volume is now in fluid communication with the oil cooler and the reservoir. The microprocessor will turn on the compressor motor and open the compressor bypass solenoid as the compressor starts. After start-up, the compressor bypass solenoid will be closed and recovered refrigerant under pressure will again be directed into the heat exchanger and then into the first variable volume of the cylinder. As the cylinder fills with recovered refrigerant, the piston strokes and hydraulic fluid is forced out through the oil cooler and into the reservoir.

The microprocessor performs other functions as well. For example, the microprocessor provides operational and diagnostic data to a keypad and display 130. It also receives operator commands from this display. The pressure transducers may be calibrated through the display.

FIG. 1 shows the preferred embodiment of the present invention 20 operatively connected to a refrigeration system 100 and a storage tank 80. Vapor inlet port 22 is fluidly connected to manifold gauge set 120 and through it to filter dryer 110, and then through a service access port into refrigeration system 100 through which high-pressure refrigerant is to be recovered. Tank outlet port 86 is fluidly connected to storage tank 80 the weight of which is measured by scales 84. Connected to evacuation port 82 is vacuum pump 140, which may be used for pre-recovery evacuation of various components. In this configuration, recovery unit 20 will remove refrigerant from system 100 and store it under high-pressure in cylinder 80.

Figure 2:
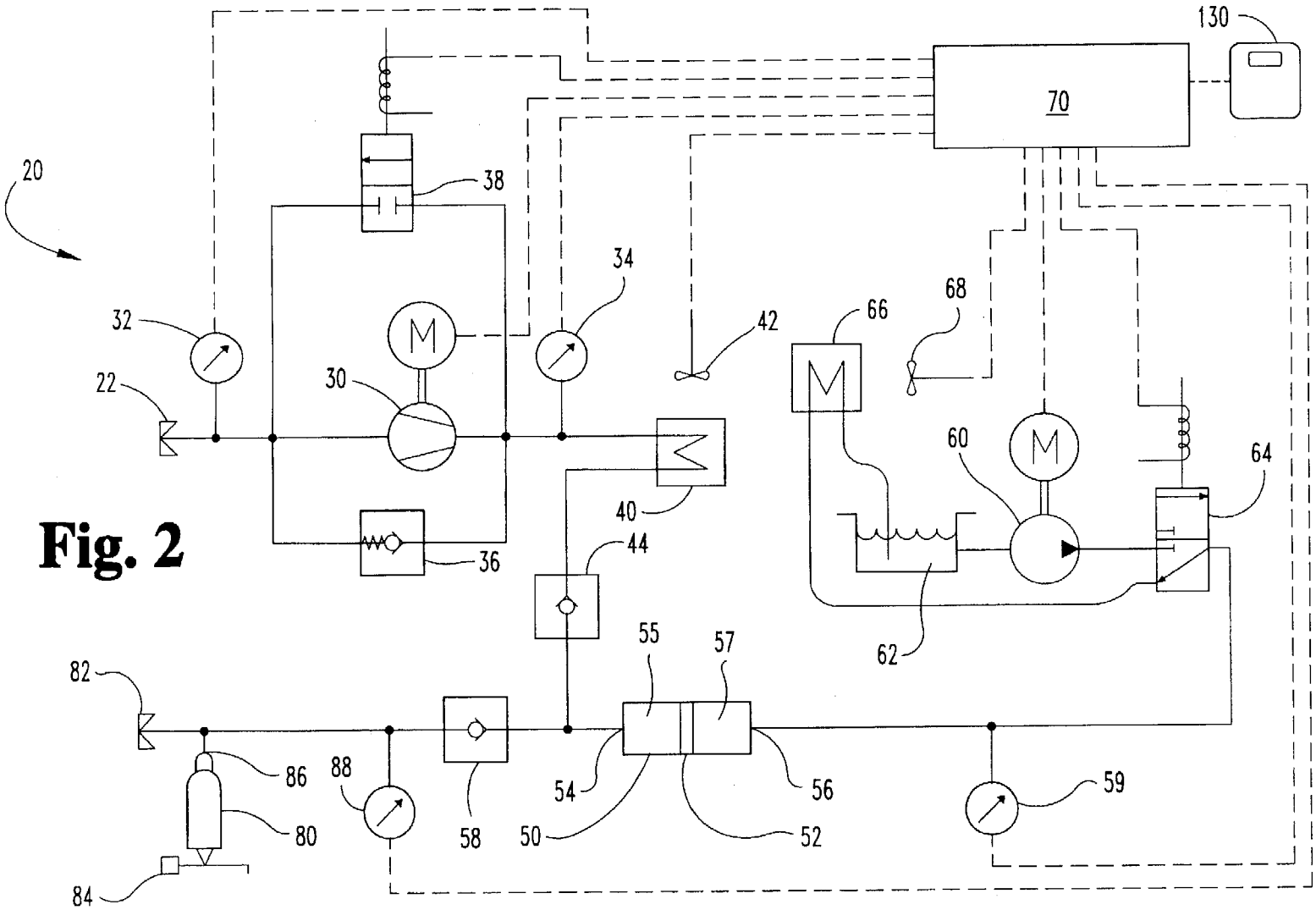
FIG. 2 is a schematic representation of the preferred embodiment of the present invention.

FIG. 2 schematically depicts the components that comprise recovery unit 20. Refrigerant present at vapor inlet port 22 is provided to the inlet of compressor 30. Measurement of refrigerant pressure at the inlet is performed by inlet pressure transducer 32 which is operatively connected to microprocessor 70.

Refrigerant is compressed by compressor 30 to approximately 250 psig. This pressure is measured by compressor discharge pressure transducer 34 located near the compressor outlet. Fluidly connected around the compressor 30 in two bypass loops are bypass relief valve 36 and compressor bypass solenoid valve 38. The latter is under control of microprocessor 70. It is opened to permit unloaded start-up of compressor 30.

Refrigerant expelled from compressor 30 passes through a de-superheater heat exchanger 40, which is air cooled by fan 42. The cooled, expelled refrigerant then passes through first check valve 44. This check valve prevents back flow of refrigerant into heat exchanger 40 and compressor 30. The outlet of first check valve 44 is fluidly connected to both refrigerant port 54 of cylinder 50 and the inlet of second check valve 58.

If pressure at the refrigerant port 54 is greater than the pressure inside storage tank 80, then refrigerant will flow through both check valves and into the storage tank. Once the pressure in storage tank 80 rises sufficiently, second check valve 58 will close and refrigerant will be able to flow only into first variable volume 57 within cylinder 50. With control valve 64 positioned such that hydraulic fluid can flow out of second variable volume 57 into reservoir 62, expelled refrigerant will continue to enter first variable volume 55 and cause piston 52 to slide toward hydraulic fluid port 56.

Once piston 52 reaches a stop within cylinder 50, pressure from the outlet of compressor 30 will suddenly rise. This rise is due to the fact that refrigerant compressed by compressor 30 can no longer flow. Compressor 30 will become dead-headed and produce its maximum outlet pressure. This change in pressure, as measured by compressor discharge pressure transducer 34, will be noted by microprocessor 70 as an estimate that piston 52 can no longer travel toward hydraulic fluid port 56.

Based on this estimate, microprocessor 70 will now turn off the motor of compressor 30, turn on the motor of hydraulic pump 60, and cycle valve 64 such that hydraulic pump outlet pressure is provided to hydraulic fluid port 56 of cylinder 50. Since hydraulic pump outlet pressure is greater than storage tank pressure, hydraulic fluid will flow into second variable volume 57, pushing piston 52 toward refrigerant port 54, with discharge of refrigerant from first variable volume 55 through check valve 58 and into storage tank 80. This discharge continues until a rise in hydraulic pump pressure is noted by microprocessor 70 via hydraulic pump output pressure transducer 59. As was the case with compressor 30, a sudden rise in output pressure will be taken by microprocessor 70 as an estimate that piston 52 has reached the end of its travel within cylinder 50. The motor of pump 60 will be turned off, valve 64 will be positioned such that hydraulic port 56 communicates with the inlet of oil cooler 66, cooled by fan 68, whose outlet is in fluid communication with reservoir 62. Reservoir 62 is near ambient pressure. Controller 70 then cycles compressor bypass solenoid valve 38 to open that bypass line, and turns on the motor of compressor 30. Compressed refrigerant will again be expelled from compressor 30, pass through heat exchanger 40, through first check valve 44, and into refrigerant port 54. Since this pressure is higher than the pressure of reservoir 62, piston 52 again begins to slide toward port 56, increasing the volume of first variable volume 55. Note that second check valve 58 prevents backflow of refrigerant from tank 80.

Refrigerant that flows past second check valve 58 is available at both evacuation port 82 and tank port 86. As shown in FIG. 2, tank port 86 is connected to tank 80, which is sitting on scales 84. The system operator must note the total weight of refrigerant within storage tank 80, and stop the operation of recovery unit 20 when tank 80 contains 80% of its specified weight of refrigerant. Outlet pressure transducer 88 measures the pressure being provided to tank 80 and provides that information to microprocessor 70 for diagnostic, safety and control functions.

Figure 3:
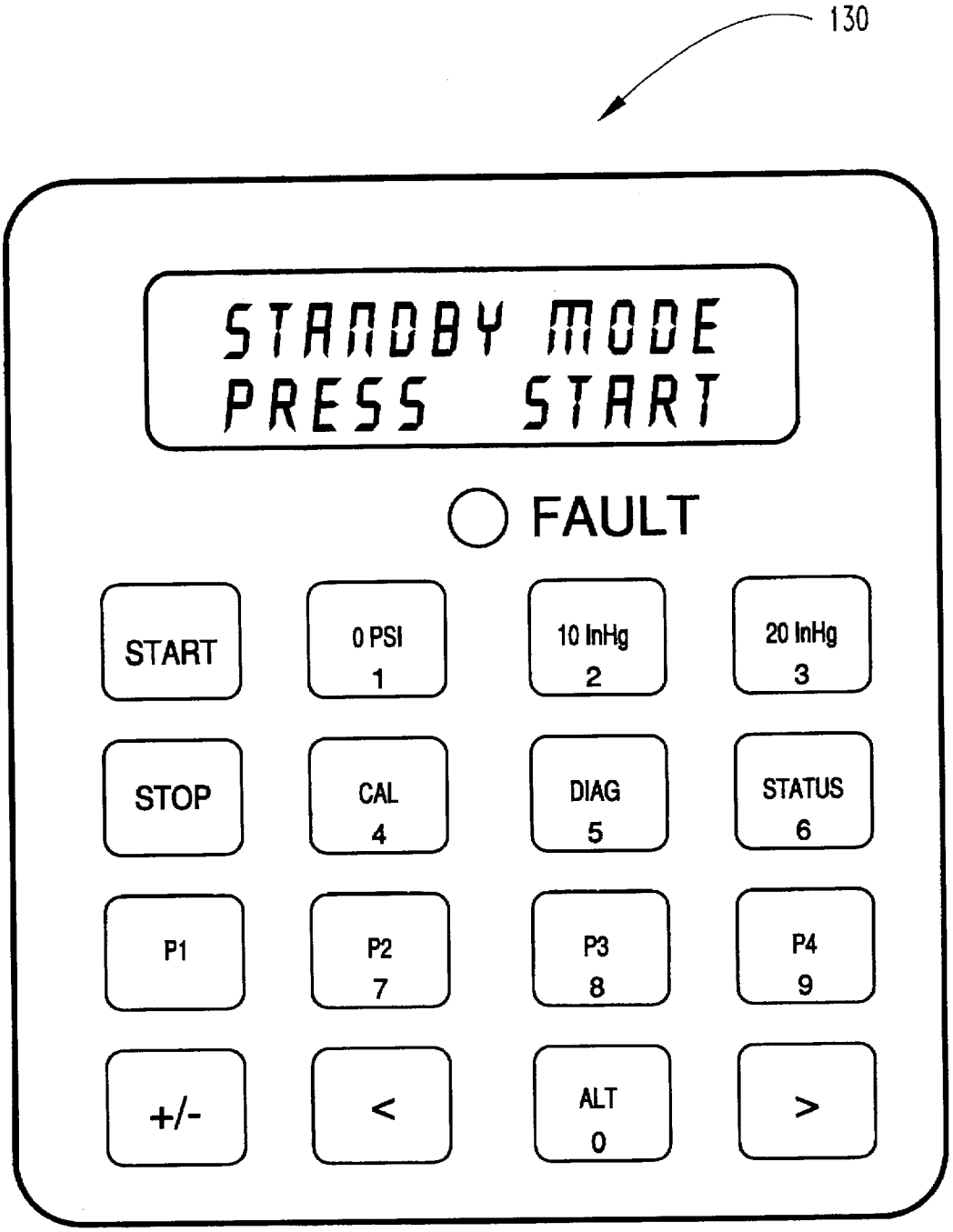
FIG. 3 shows the keypad and display of recovery unit 20.

FIG. 3 shows keypad and display 130 of recovery unit 20. Keypad and display 130 permits microprocessor 70 to display to the operator necessary information about operation of the system. It also permits the operator to command the microprocessor, calibrate the pressure transducers, and read error messages within microprocessor 70.

Figure 4:
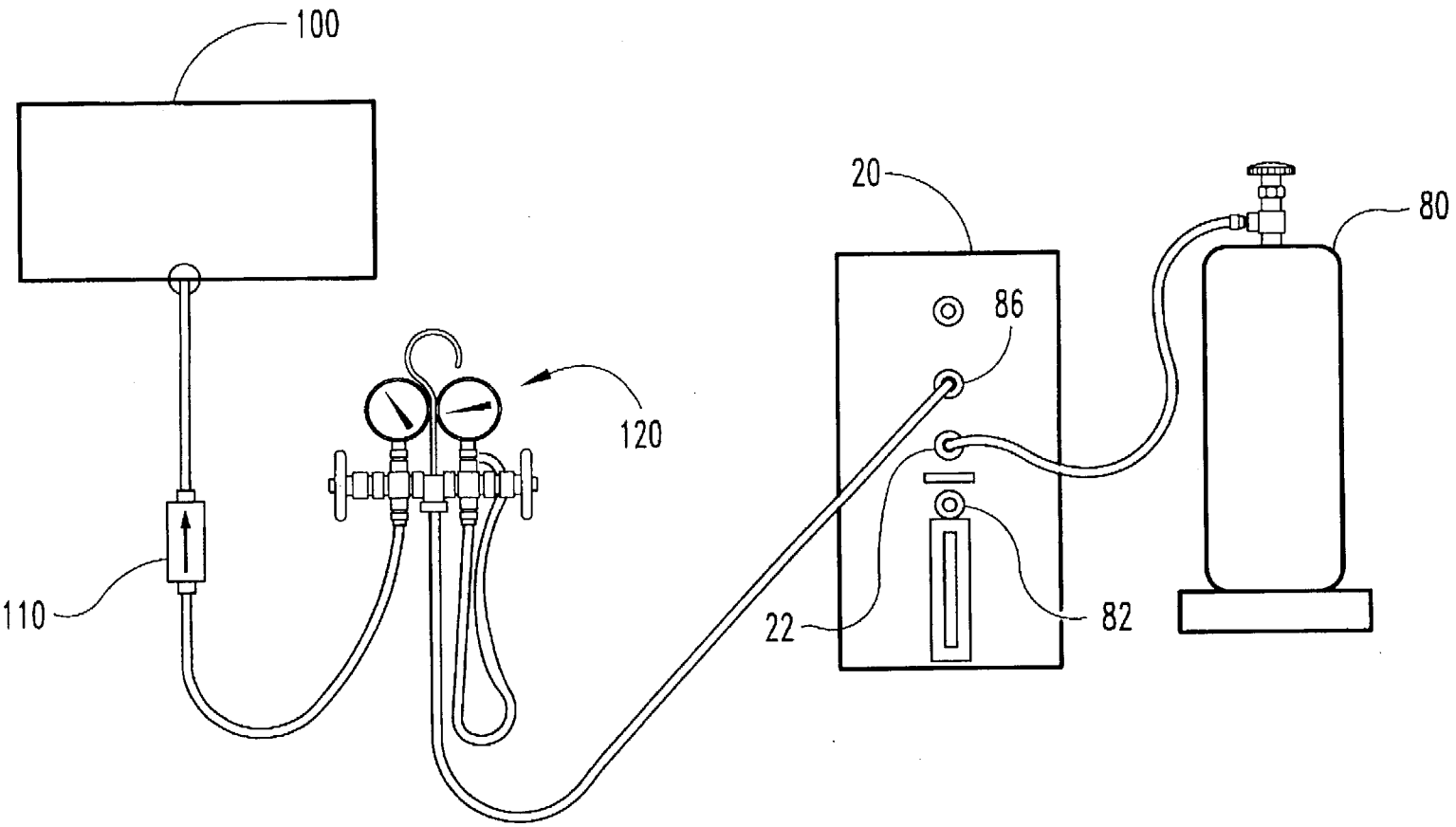
FIG. 4 shows the preferred embodiment of the present invention configured to charge a refrigeration system from a tank of refrigerant.

FIG. 4 shows recovery unit 20 as configured to charge refrigeration system 100 from tank 80. Tank 80 is fluidly connected to vapor inlet port 22. Tank port 86 is connected to manifold gauge set 120, which in turn permits refrigerant through to filter/dryer 110 and into a service access port of refrigeration system 100. Recovery unit 20 is useful in this configuration after standard charging procedures have been used to provide refrigerant directly from tank 80 into refrigeration system 100, and tank and system pressures have equalized. As configured in FIG. 4, recovery unit 20 will continue withdrawing vapor from tank 80 and charging it into system 100.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus system for recovering and charging refrigerant of a refrigeration system, comprising:

a compressor for receiving refrigerant and expelling it at a higher pressure;

a cylinder defining an internal chamber, with a refrigerant port and a hydraulic fluid port;

a first check valve permitting flow of expelled, higher pressure refrigerant to the refrigerant port of said cylinder, and restricting refrigerant flow out of said cylinder;

a piston slidably movable within said cylinder and dividing the internal chamber into a first variable volume in fluid communication with the refrigerant port and a second variable volume in fluid communication with the hydraulic fluid port;

means for hydraulically actuating said piston, whereby supply of low pressure hydraulic fluid to the hydraulic fluid port results in intake of expelled, higher pressure refrigerant into the first variable volume, and supply of high-pressure hydraulic fluid to the hydraulic port results in discharge of refrigerant from the first variable volume;

a controller for cycling of said piston actuating means between supply of low pressure and high-pressure hydraulic fluid; and a second check valve permitting refrigerant flow out of the refrigerant port of said cylinder, and restricting refrigerant flow into the refrigerant port of said cylinder.

2. The apparatus of claim 1, further comprising a heat exchanger for cooling the expelled, higher pressure refrigerant.

3. The apparatus of claim 2, wherein said heat exchanger is air cooled.

4. The apparatus of claim 3, wherein said piston actuating means comprises:

a reservoir of hydraulic fluid;

a hydraulic pump with an inlet receiving fluid from said reservoir and with an outlet providing pressurized hydraulic fluid;

a control valve with a first position establishing fluid communication between said reservoir and the hydraulic fluid port and a second position establishing fluid communication between said pump outlet and the hydraulic fluid port.

5. The apparatus of claim 4, wherein said compressor is a piston type.

6. The apparatus of claim 5, wherein said controller is an electronic digital type.

7. The apparatus of claim 1, wherein said piston actuating means comprises:

a reservoir of hydraulic fluid;

a hydraulic pump with an inlet receiving fluid from said reservoir and with an outlet providing pressurized hydraulic fluid;

a control valve with a first position establishing fluid communication between said reservoir and the hydraulic fluid port and a second position establishing fluid communication between said pump outlet pump and the hydraulic fluid port.

8. The apparatus of claim 1, wherein said compressor is a piston type.

9. The apparatus of claim 1, wherein said controller is an electronic digital type.

10. The apparatus of claim 9, further comprising a first pressure transducer for measurement of hydraulic fluid pressure and operatively connected to said controller.

11. The apparatus of claim 10, whereby said controller uses the hydraulic pressure measurement to estimate completion of the discharge of refrigerant from the first variable volume.

12. The apparatus of claim 9, further comprising a second pressure transducer for measurement of compressor outlet pressure and operatively connected to said controller.

13. The apparatus of claim 12, whereby said controller uses the compressor outlet pressure measurement to estimate completion of the intake of expelled refrigerant into the first variable volume.

14. An apparatus system for recovering refrigerant of a refrigeration system into a container, comprising:

a compressor for receiving refrigerant from the refrigeration system and expelling it at a higher pressure;

a heat exchanger for cooling refrigerant from said compressor;

a cylinder defining an internal chamber, said cylinder including a refrigerant port receiving refrigerant from said heat exchanger;

a piston slidably movable within said cylinder and defining with the internal chamber a variable volume in fluid communication with the refrigerant port;

means for actuating said piston, whereby refrigerant discharges from the variable volume; and a controller for cycling of said piston actuating means.

15. The apparatus of claim 14, wherein said cylinder includes a hydraulic fluid port, and wherein said piston actuating means includes a reservoir of hydraulic fluid, a hydraulic pump with an inlet receiving fluid from said reservoir and with an outlet providing pressurized hydraulic fluid, and a control valve with a first position establishing fluid communication between said reservoir and the hydraulic fluid port and a second position establishing fluid communication between said pump outlet and the hydraulic fluid port.

16. The apparatus of claim 15, further comprising a pressure transducer for measurement of hydraulic fluid pressure and operatively connected to said controller.

17. The apparatus of claim 16, whereby said controller uses the hydraulic pressure measurement to estimate completion of the discharge of refrigerant from the variable volume.

18. The apparatus of claim 14, wherein said controller is an electronic digital type.

19. The apparatus of claim 18, further comprising a pressure transducer for measurement of compressor outlet pressure and operatively connected to said controller.

20. The apparatus of claim 14, further comprising a first check valve permitting flow of refrigerant into the refrigerant port, and a second check valve permitting flow out of the refrigerant port.

21. The apparatus of claim 14, wherein said compressor is a piston type.

22. An apparatus system for recovering refrigerant of a refrigeration system into a container, comprising:

a compressor in fluid communication with the refrigeration system and compressing refrigerant to a first higher pressure, said compressor having an outlet;

a cylinder with a piston defining a variable volume, said cylinder having a length;

a first check valve in fluid communication with the outlet of said compressor, said first check valve permitting intake of refrigerant from said compressor to the variable volume;

means for actuating said piston along the length of said cylinder, whereby said refrigerant is compressed to a second higher pressure; and a second check valve permitting discharge of refrigerant out of said cylinder and into the container.

23. The apparatus of claim 22, further comprising a digital electronic controller for controlling said piston actuating means.

24. The apparatus of claim 23, wherein said cylinder includes a hydraulic fluid port, and wherein said piston actuating means comprises a reservoir of hydraulic fluid, a hydraulic pump with an inlet receiving fluid from said reservoir and with an outlet providing pressurized hydraulic fluid, and a control valve with a first position establishing fluid communication between said reservoir and the hydraulic fluid port and a second position establishing fluid communication between said pump outlet and the hydraulic fluid port.

25. The apparatus of claim 24, further comprising a pressure transducer for measurement of hydraulic fluid pressure and operatively connected to said controller.

26. The apparatus of claim 25, whereby said controller uses the hydraulic pressure measurement to estimate completion of the discharge of refrigerant from the variable volume.

27. The apparatus of claim 23, further comprising a pressure transducer for measurement of compressor outlet pressure and operatively connected to said controller.

28. The apparatus of claim 27, whereby said controller uses the compressor outlet pressure measurement to estimate completion of the intake of refrigerant into the variable volume.

29. The apparatus of claim 22, further comprising a heat exchanger for cooling of refrigerant from said compressor.

30. The apparatus of claim 22, wherein said compressor is a piston type.

31. An apparatus system for recovering refrigerant of a refrigeration system, comprising:

a compressor in fluid communication with the refrigeration system and compressing refrigerant to a first pressure, said compressor having an outlet;

a cylinder with a piston defining a variable volume for intaking of refrigerant from the outlet of said compressor, said cylinder having a length;

means for actuating said piston along the length of said cylinder, whereby refrigerant in the variable volume is compressed to a second pressure, the second pressure being higher than the first pressure;

an electronic controller for control of said piston actuating means; and a first pressure transducer for measurement of compressor outlet pressure and operatively connected to said controller;

wherein said controller uses the compressor outlet pressure measurement to estimate completion of the intaking of refrigerant.

32. The apparatus of claim 31, wherein said cylinder includes a hydraulic fluid port, and wherein said piston actuating means comprises a reservoir of hydraulic fluid, a hydraulic pump with an inlet receiving fluid from said reservoir and with an outlet providing pressurized hydraulic fluid, and a control valve with a first position establishing fluid communication between said reservoir and the hydraulic fluid port and a second position establishing fluid communication between said pump outlet and the hydraulic fluid port.

33. The apparatus of claim 32, further comprising a second pressure transducer for measurement of hydraulic fluid pressure and operatively connected to said controller, whereby said controller uses the hydraulic pressure measurement to estimate completion of the compression of refrigerant to the second pressure.

34. The apparatus of claim 31, further comprising a heat exchanger for cooling of refrigerant from said compressor.

35. The apparatus of claim 31, wherein said compressor is a piston type.

36. The apparatus of claim 31 further comprising a first check valve permitting intaking of refrigerant into the variable volume.

37. An apparatus system for recovering refrigerant of a refrigeration system, comprising:

a compressor in fluid communication with the refrigeration system, said compressor having an outlet, said compressor being driven by a motor;

a cylinder with a piston defining a variable volume in fluid communication with the outlet of said compressor, the variable volume being variable between a full position and a discharged position;

means for actuating said piston to the discharged position;

an electronic controller operatively connected to the motor of said compressor; and a compressor outlet pressure transducer for measurement of compressor outlet pressure and operatively connected to said controller;

wherein said controller uses the compressor outlet pressure measurement to control the motor.

38. The apparatus of claim 37, wherein said controller is an electronic digital type.

39. The apparatus of claim 38, wherein said cylinder includes a hydraulic fluid port, and wherein said piston actuating means comprises a reservoir of hydraulic fluid, a hydraulic pump with an inlet receiving fluid from said reservoir and with an outlet providing pressurized hydraulic fluid, and a control valve with a first position establishing fluid communication between said reservoir and the hydraulic fluid port and a second position establishing fluid communication between said pump outlet and the hydraulic fluid port.

40. The apparatus of claim 39, further comprising a hydraulic fluid pressure transducer for measurement of hydraulic fluid pressure and operatively connected to said controller.

41. The apparatus of claim 40, whereby said controller uses the hydraulic pressure measurement to estimate completion of the discharge of refrigerant from the first variable volume.

42. The apparatus of claim 37, wherein said compressor is a piston type.

43. The apparatus of claim 37, further comprising a heat exchanger for cooling of refrigerant from said compressor.

44. The apparatus of claim 37 further comprising a check valve permitting flow of refrigerant from said compressor to the variable volume.

* * * * *